United States Patent [19]

Figured

[11] Patent Number: 4,625,420

[45] Date of Patent: Dec. 2, 1986

[54] BOW SIGHT FOR COMPOUND BOWS

[76] Inventor: Jack Figured, 446 - 15th St., Scranton, Pa. 18504

[21] Appl. No.: 829,174

[22] Filed: Feb. 14, 1986

[51] Int. Cl.[4] ..... F41G 1/46

[52] U.S. Cl. ..... 33/265; 124/87

[58] Field of Search ..... 33/265; 124/24 R, 87

[56] References Cited

U.S. PATENT DOCUMENTS

| | | | |
|---|---|---|---|
| 2,982,026 | 5/1961 | Peterson | 33/265 |
| 3,063,151 | 11/1962 | Hanson | 33/265 |
| 3,271,863 | 9/1966 | Harrington | 33/265 |
| 3,368,282 | 2/1968 | Gibson et al. | 33/265 |
| 3,455,027 | 7/1969 | Perkins | 33/265 |
| 4,332,231 | 6/1982 | Napier et al. | 124/87 |

*Primary Examiner*—Charles Frankfort
*Assistant Examiner*—Patrick R. Scanlon
*Attorney, Agent, or Firm*—Ruth Moyerman

[57] ABSTRACT

A sighting device to be used on compound bows includes a mounting plate and a sight assembly. The mounting plate is fastened to a bow belly side with a portion extending beyond the bow front to receive the sight assembly. The sight assembly has a rod, a sleeve, and a wire rod sight with two peep holes. The sight is transversely mounted through the rod and sleeve, the rod journalled through the sleeve. The rod is rotatably retained in the mounting plate and as the rod rotates, the sight pivots to provide both gross and fine sight adjustment.

11 Claims, 6 Drawing Figures

BOW SIGHT FOR COMPOUND BOWS

BACKGROUND OF THE INVENTION

1. Field of the Invention

This invention relates to compound bows, and more particularly to a sight to be mounted on a compound bow.

2. Background of the Prior Art

Throughout the years, archers have used many sighting devices to help them achieve their target goals. One of the more simple devices is U.S. Pat. No. 4,215,485 to Mesler where an arrow is sighted by placing it through a sight on the bow.

There are many more complicated devices used for sighting. Rasmussen (U.S. Pat. No. 4,528,973) uses a spring loaded ball to lock an adjustable sight; Altier (U.S. Pat. No. 4,142,297) hinges the sight to provide attachment of sight to bow; Westphal (U.S. Pat. No. 3,766,656) shows a motor driven adjustable sight; Diamond (U.S. Pat. No. 3,674,002) adjusts the sight by using a reel and filament; Peterson (U.S. Pat. No. 2,982,026) uses a tongue and channel arrangement to adjust the sight; Beloungy (U.S. Pat. No. 2,559,927) employs a spring to provide vertical and horizontal adjustment and Tate (U.S. Pat. No. 2,163,503) has a dismantling combination of bow and sight for compact storage.

None of the prior art devices show a sight which is rotatable and pivotable to provide, at one spot, for both horizontal and vertical fine adjustment. Also, none of the prior art devices show a device which is simple to manufacture and easy for the archer to mount and use while still providing pivotable sight adjustment.

SUMMARY OF THE DISCLOSURE

The sighting device of this invention is simple to mount and use. A sight mounting plate, preferably with windage adjusters, is fastened to one side of a bow belly so that a portion of the plate extends beyond the bow front, the extended portion preferably having a plurality of sight receiving apertures.

An archer selects an aperture in which to place the sight depending on his size and manner of holding the bow. The sight is preferably tubular so it can be rotated 360° in the aperture. The sight assembly has three sections—a preferably tubular sleeve, a rod sized to be journalled through the sleeve and the mounting plate aperture, and a sight. The sight is preferably a wire rod terminating in dissimiliarly-sized eye holes. The sight shaft is mounted transversely through both rod and sleeve. Thus, when the rod is rotated in the plate apertures, the sight pivots to provide fine adjustment.

Indicia can be mounted on the other bow belly side to aid in sight alignment.

It is, therefore, an object of this invention to provide a bow sight with both gross and fine adjustment, both horizontal and vertical, to the bow's vertical plane.

It is another object of this invention to provide a bow sight which may be mounted to any compound bow.

It is yet another object of this invention to provide a bow sight with windage adjustment.

It is still another object of this invention to provide a bow sight which is simple to adjust, yet held firmly in position when adjustment is complete.

It is a further object of this invention to provide a bow sight employing two eye holes on the sight.

It is yet a further object of this invention to provide indicia means to aid in sight adjustment.

These and other objects will be more readily ascertainable to one skilled in the art from a consideration of the following Figures, description and exemplary embodiments.

BRIEF DESCRIPTION OF THE DRAWING(S)

Figure 3:
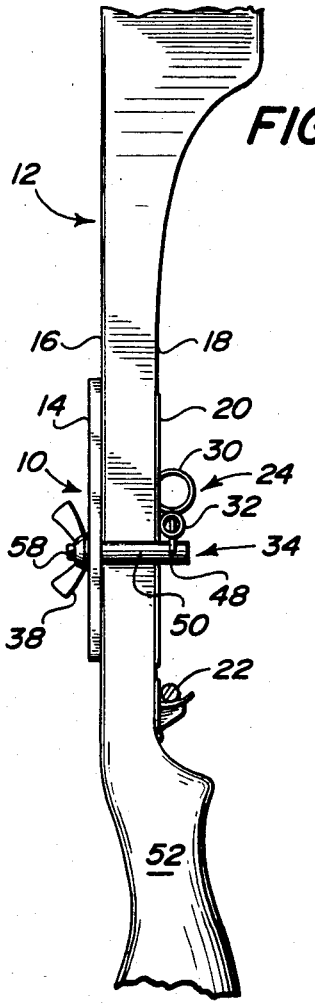
Figure 1:
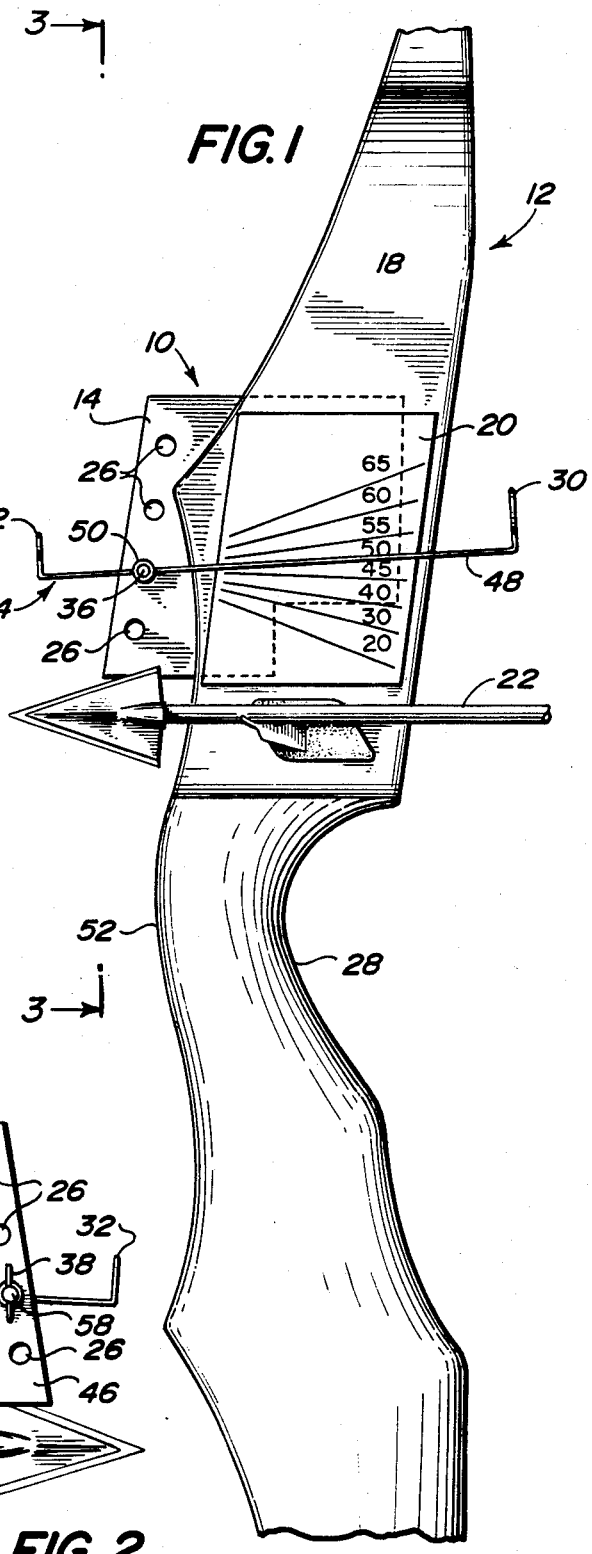
FIG. 1 is a side view showing the sighting device of this invention mounted on one bow belly side, indicia means on the other bow side.

FIG. 3, a fragmentary cross section taken on lines 3—3 of FIG. 1, illustrates the sight assembly mounted through the plate.

Figure 4:
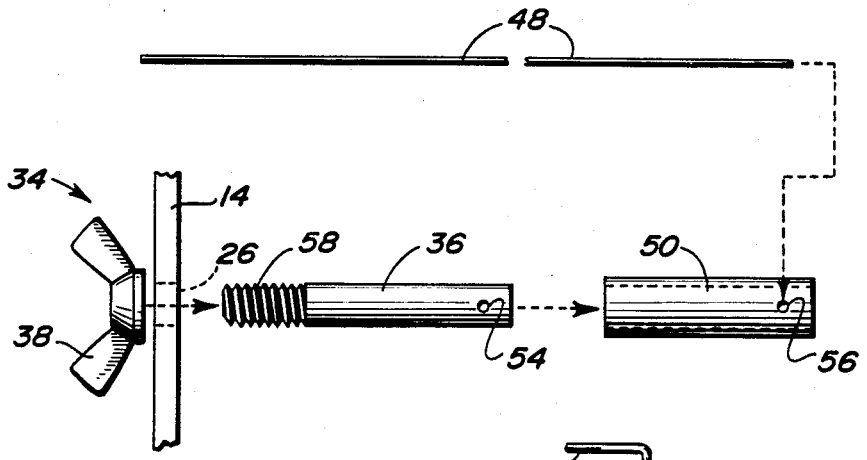

FIG. 4 is an exploded view of the sight assembly.

Figure 5:
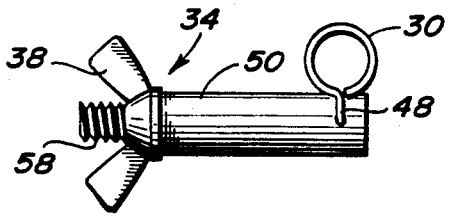

FIG. 5 is a side view of the sight assembly assembled.

Figure 6:
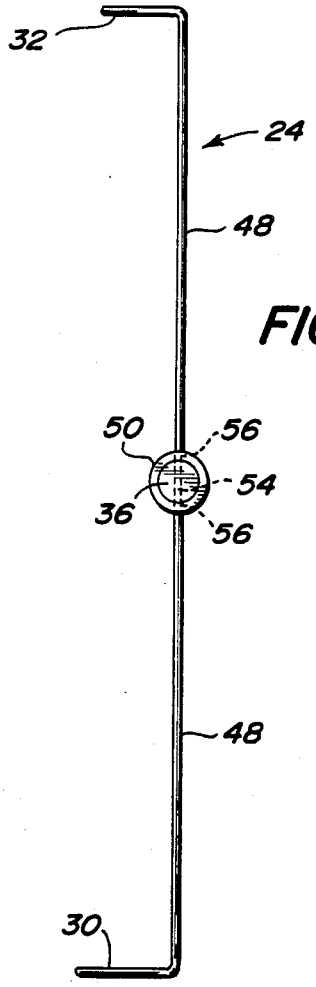

FIG. 6 is a front view of the sight rod and sleeve.

DETAILED DESCRIPTION OF THE PREFERRED EMBODIMENT(S)

Figure 2:
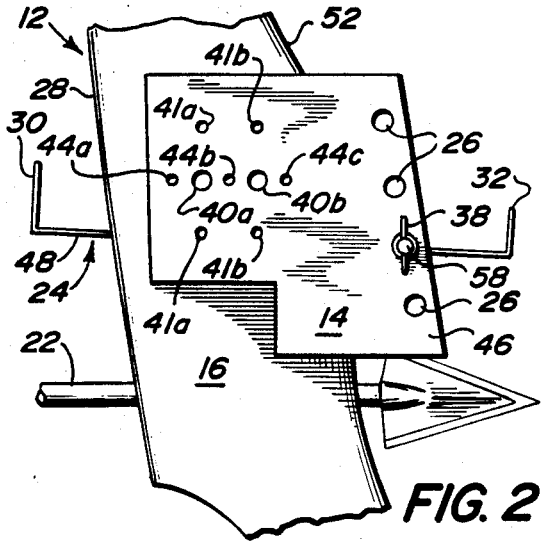
FIG. 2 is a fragmentary view of the bow belly showing the mounting plate.

Now referring to the drawings and more particularly to FIGS. 1, 2 and 3, sighting device 10 of this invention is shown fastened to compound bow 12. Mounting plate 14 is mounted to bow belly side 16 (seen in more detail in FIG. 2). Indicia tape 20 is fastened to bow side 18. Sight 24 is seen mounted to bow 12 through plate 14 (mounting is better seen in FIGS. 1 and 2). Apertures 26 are seen in plate 14 to receive sight 24.

In use, an archer attaches plate 14 to a bow belly side—to the right side if he is right-handed, to the left side if he is left-handed. Then, according to his size and manner of shooting, he selects an aperture 26 in which to place sight assembly 34 (seen best in FIGS. 4 and 5). After tightening assembly 34 in place (by tightening nut 38 as seen in FIG. 3), he then pivots sight 24 to determine the angle of arrow placement for various target distances. When, by experiment, he has determined the correct angle of sight 24 for each distance, he charts the necessary angles on indicia tape 20 by marking lines on tape 20 which parallel the position of sight 24 for each distance. To shoot arrow 22, the archer stands facing bow back 28 with bow front 52 facing the target, and holds arrow 22 in position to mimic the angle of sight 24.

It is seen in FIGS. 1, 2 and 3 that arrow sighting device 10 is adjustable in several ways. Sight assembly 34 is placed in one of apertures 26 to provide for gross vertical adjustment. Since it is likely that only one archer will use bow 12, placement in a chosen aperture 26 will probably be made only one time. However, it is easy to change placement of sight assembly 34 by moving rod 36 to another aperture 26 (assembly 34 is best seen in FIGS. 4 and 5). Because rod 36 rotates in aperture 26, sight 24 pivots 360° to provide infinite adjustment for varying distances. Additionally, sight 24 rotates in rod 36 to allow for 360° rotation to suit the style and size of the archer.

Now referring particularly to FIG. 2, mounting plate 14 is seen attached to bow belly side 16 with extension 46 reaching beyond bow front 52 to provide clearance for sight assembly 34 (seen better in FIGS. 4 and 5). Threaded end 58 of rod 36 is seen held in an aperture 26 by locking nut 38. Sight 24 is seen beyond bow 12, parallel to arrow 22.

Of particular interest in FIG. 2 are apertures 40 and 41 (shown as two sets of three in two vertical rows) into which will be placed fasteners. Two sets of apertures 40 and 41 are provided to accommodate for differently sized bows. Whichever set of apertures provides clearance for aperture 26 is chosen.

Also seen in FIG. 2 are three windage adjusters 44 which are selected according to which set of mounting apertures were used and in what direction adjustments must be made. For example, if mounting apertures 40A and 41A are used, windage adjuster 44A is used to make left adjustment and 44B is used for right adjustment. If mounting apertures 40B and 41B are used, windage adjuster 44B is used for left adjustment and 44C for right adjustment. Windage adjusters 44 are preferably Allen screws which, when tightened, will change the bias of plate 14, adjusting sighting device 10 for wind deflection.

If an arrow hits to the right of a target when mounting apertures 40A and 41A are used, adjuster 44A is loosened and 44B is tightened. If the arrow hits to the left of a target, aperture 44B is loosened and aperture 44A is tightened. When mounting apertures 40B and 41B are used, 44B is loosened and 44C is tightened to adjust for shooting too far to the right, and 44B is tightened and 44C is loosened to adjust for arrows shot too far to the left.

Now referring to FIG. 3, a fragmentary view taken on lines 3—3 of FIG. 1, sight assembly 34 is seen mounted through plate 14. Rod 36 extends through sleeve 50 and plate 14 to be held to plate 14 on its threaded end 58 by locking nut 38. Assembly 34 holds sight 24 firmly to bow 12 because sleeve 50 is pressed tightly against plate 14 by nut 38. Sight 24 has two peep holes—larger hole 30 which is nearest the archer and smaller hole 32 which extends beyond the bow front 52 (as seen in FIG. 1).

Now referring to FIG. 4, an exploded dismantled view of sight assembly 34 is seen including sight shaft 48, sight support rod 36, sleeve 50 and nut 38. Once assembled by a manufacturer with rod 36 journalled through sleeve 50, intermediate shaft 48 rotatably extends through channel 54 and apertures 56 in rod 36 and sleeve 50, respectively. After insertion through channel 54 and apertures 56, ends of intermediate shaft 48 may be bent to form eyeholes 30 and 32 as seen in FIGS. 1 and 3.

In use, an archer inserts threaded end 58 through an aperture 26 in plate 14 and tightens nut 38 to hold sight assembly 34 firmly to plate 14.

The importance of sleeve 50 is illustrated in FIG. 4. When nut 38 is tightened, sleeve 50 is pulled tightly to plate 14. Thus, a spring-like tension is produced between nut 38, sight support rod 36, sight 24 and sleeve 50 which keeps sight 24 from moving when an arrow is shot.

Now referring to FIG. 5, sight assembly 34 is seen assembled. Eyehole 30 is seen on shaft 48, extending transversely through sleeve 50. Rod end 58 is seen with nut 38 threaded onto it and pressing against sleeve 50.

In FIG. 6, sight 24 is seen with eyeholes 30 and 32. Shaft 48 extends through channel 54 in rod 36 and apertures 56 in sleeve 50. Rotatability of shaft 48 is important because it allows for 360° adjustment to the position of eyeholes 30 and 32. This allows mounting on either side of a bow as well as accommodating for different archer's preferences.

There are several advantages to device 10. Primarily, the rotatability of sight assembly in aperture 26 allows sight 24 to pivot for infinite sighting adjustment for target distance.

Second, rotatability of shaft 48 in rod 36 and sleeve 50 provides adjustment for different archer's size and style of shooting.

Third, tightening of nut 38 to pull sleeve 50 against plate 14 tensions sight assembly 34 so that sight 24 is unmoving during shooting.

There are variations possible with device 10 which are within the scope of this invention. While it is preferred for consistent accuracy to use indicia 20, such use is not required.

Also, although four apertures 26 are shown, this number may be varied. For versatility of use with multiple bows, two sets of apertures 40 with fasteners 42 are shown. One or more sets are within the scope of this invention.

Having now illustrated and described my invention, it is not my intention that such description limit the invention, but that the invention be limited only by a reasonable interpretation of the appended claims.

What is claimed is:

1. A sighting device to be used with a compound bow having a belly, said sighting device comprising:

(a) a generally planar bow mounting plate sized to be mountable on a side of said bow belly so that a portion of said plate extends beyond the front of said bow to form a bracket, said bracket including a plurality of sight assembly apertures; and, (b) a rotatable sight assembly including a sleeve, a sight support rod journalled through said sleeve and sight means connected by an intermediate shaft, said shaft mounted transversely through said sight support rod and sleeve, wherein said sight support rod is inserted into one of said plurality of sight assembly apertures to rotatably attach said sight assembly to said mounting plate, so that said sight means are pivotably adjustable for varying target distances.

2. The sighting device according to claim 1 wherein said slight support rod comprises a threaded rod end extension to receive a locking nut, whereby when said lock nut is tightened, said sleeve is urged against said plate to hold said sight assembly in unmoving registration with said bow.

3. The sighting device for a bow according to claim 1 wherein said mounting plate includes, additionally, windage adjusters, said windage adjusters being generally apertures filled with adjustable screws which, when turned, adjust the orientation of said plate with respect to said bow to compensate for wind deflection of shot arrows.

4. The sighting device according to claim 1 including, additionally, means on a side of said bow belly opposite the mounting plate to receive indicia to aid in alignment of said sight assembly for varying target distances.

5. The sighting device according to claim 1 wherein said intermediate shaft is generally a straight wire rod and said sight means are dissimilarly-sized matching eyeholes mounted at both ends of said shaft.

6. The sighting device according to claim 1 wherein said mounting plate is L-shaped.

7. The sighting device according to claim 1 wherein said mounting plate includes, additionally, apertures to receive mounting means to fasten said plate to said bow.

8. A sighting device to be used with a compound bow having a belly, said sighting device comprising:

(a) a generally planar bow mounting plate adapted to be mountable on one side of said bow belly, a portion of said plate extending beyond the front of said bow to form a bracket, said bracket including a plurality of sight receiving apertures;

(b) a sight support rod extending transversely through one of said plurality of sight receiving apertures in said bracket, one end of said rod including means to rotatably mount said sight support rod to said bracket, the other rod end including at least one channel to transversely receive a sight;

(c) a sight support sleeve circumscribing a portion of said sight support rod, said rod journalled through said sleeve, said sleeve including a means to receive a sight;

(d) a sight with at least two peep holes connected by an intermediate shaft, said shaft running transversely through said means to receive a sight of said sleeve and said channel of said rod; and, (e) said means to rotatably mount said sight support rod to said bracket having an axis of rotatability that is perpendicular to said bracket to thereby permit said sight to be pivotably adjustable for varying distances.

9. The sighting device according to claim 8 including, additionally, means on a side of said bow belly opposite the mounting plate to receive indicia to aid in alignment of said sight in its various positions for predetermined distances.

10. The sighting device according to claim 8 including, additionally, at least two windage adjusters on said mounting plate, said adjusters being apertures with screws which are turned to adjust said mounting plate to accommodate for wind deflection of arrows.

11. The sighting device according to claim 8 wherein said sight support rod comprises a threaded rod end extension to receive a locking nut, whereby when said lock nut is tightened, said sleeve is urged against said plate to hold said sight in unmoving registration with said bow.

* * * * *